US009637932B2

(12) United States Patent
Schneider et al.

(10) Patent No.: US 9,637,932 B2
(45) Date of Patent: May 2, 2017

(54) RAILING AND BALUSTER PLUG SYSTEM

(71) Applicant: Barrette Outdoor Living, Inc., Middleburg Heights, OH (US)

(72) Inventors: Christopher Michael Schneider, Mays Landing, NJ (US); Michael Matthew DeSalle, Northfield, NJ (US); Wayne E. Dixon, Chuckey, TN (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 0 days.

(21) Appl. No.: 14/511,424

(22) Filed: Oct. 10, 2014

(65) Prior Publication Data

US 2015/0115214 A1 Apr. 30, 2015

Related U.S. Application Data

(60) Provisional application No. 61/897,396, filed on Oct. 30, 2013.

(51) Int. Cl.
*E04H 17/14* (2006.01)
*E04F 11/18* (2006.01)

(52) U.S. Cl.
CPC ..... *E04F 11/1844* (2013.01); *E04F 11/1834* (2013.01); *E04H 17/1421* (2013.01); *E04H 2017/1482* (2013.01); *E04H 2017/1491* (2013.01)

(58) Field of Classification Search
CPC ..... E04F 11/1834; E04F 2011/1897; E04F 11/1817; E04F 11/1844; E04F 11/1836; E04F 11/1838; E04F 11/184; E04H 17/1421; E04H 17/1482; E04H 2017/1491
USPC ..... 256/76
See application file for complete search history.

(56) References Cited

U.S. PATENT DOCUMENTS 3,306,586 A * 2/1967 Green ..... E04F 11/1834 256/22
3,804,374 A * 4/1974 Thom ..... E04F 11/181 256/59
4,138,094 A * 2/1979 Thir ..... E04F 11/1834 182/159
4,150,907 A * 4/1979 Thurnauer ..... E04F 11/1834 256/67
4,272,061 A * 6/1981 Suckno ..... E04F 11/1834 256/22

(Continued)

FOREIGN PATENT DOCUMENTS

DE 102004029497 A1 * 1/2006 ..... E04F 11/181
FR 2870879 A1 * 12/2005 ..... E04H 17/1421
IT EP 0321593 A1 * 6/1989 ..... B27M 3/12

OTHER PUBLICATIONS

Barrette Elite Stair Rail Owner's Manual Version 5.0, Dec. 2012 Barrette Outdoor Living, Middleburg, Ohio.

*Primary Examiner* — Dan Wiley
*Assistant Examiner* — Matthew R McMahon
(74) *Attorney, Agent, or Firm* — Maldjian Law Group LLC

(57) ABSTRACT

A railing and baluster plug system that facilitates installation of balusters at a plurality of angular orientations, such as installations for level railing and installations for non-level or angled railings such as for stairs. The baluster plugs are configured to cooperate with the balusters and include both a level mounting surface and an angled mounting surface for alternatively mounting the balusters in a level or an angled orientation.

16 Claims, 22 Drawing Sheets

(56) References Cited

U.S. PATENT DOCUMENTS 4,421,302 A * 12/1983 Grimm ..... E04F 11/1834 256/59
4,886,245 A * 12/1989 Manzo ..... E04F 11/1834 256/65.08
4,928,930 A * 5/1990 Chung ..... E04F 11/1834 256/65.03
5,056,283 A * 10/1991 Sapinski ..... E04F 11/1834 256/65.11
5,873,671 A * 2/1999 West ..... E04F 11/1834 256/59
6,145,814 A * 11/2000 Perrot ..... E04F 11/1834 256/59
6,308,937 B1 * 10/2001 Pettit ..... E04F 11/181 256/65.05
6,698,726 B2 * 3/2004 Platt ..... E04F 11/1834 16/224
6,889,960 B1 * 5/2005 Jones ..... E04F 11/1834 256/19
6,913,249 B1 * 7/2005 Lerdu ..... E04H 17/16 256/24
6,932,329 B1 * 8/2005 Harder ..... E04F 11/1834 256/19
7,744,065 B2 6/2010 Terrels et al.
7,762,533 B2 * 7/2010 DeRogatis ..... E04F 11/181 256/22
D629,284 S * 12/2010 Loftus ..... D13/133
7,913,960 B1 3/2011 Herr, III et al.
D643,706 S * 8/2011 Lappin ..... D8/382
D643,707 S * 8/2011 Lappin ..... D8/382
8,167,275 B1 5/2012 Bizzarri et al.
2004/0025452 A1 * 2/2004 McLean ..... E04F 11/02 52/182
2004/0211952 A1 * 10/2004 Barnes ..... E04F 11/1812 256/60
2007/0145341 A1 * 6/2007 Brucker ..... E04H 17/16 256/59
2009/0179183 A1 * 7/2009 Ferris ..... E04F 11/1834 256/67
2009/0272957 A1 * 11/2009 Nelson ..... E04F 11/1834 256/65.01
2010/0237309 A1 * 9/2010 Ferris ..... E04F 11/1817 256/65.01
2011/0073824 A1 * 3/2011 Lappin ..... E04F 11/1817 256/65.08
2014/0346422 A1 * 11/2014 Langenwalter ..... E04H 17/1426 256/67

* cited by examiner

RAILING AND BALUSTER PLUG SYSTEM

CROSS-REFERENCE TO RELATED APPLICATION

This application claims priority to U.S. Provisional Application No. 61/897,396, filed Oct. 30, 2013, entitled Railing and Baluster Plug System, and incorporated by reference herein in its entirety.

FIELD

The present disclosure relates to a railing system and baluster plug system for installation of railing assemblies having a plurality of balusters. More particularly, the disclosure relates to a railing system and a baluster plug system for installation of railing assemblies having a plurality of balusters that enables balusters to be installed at a plurality of angular orientations.

BACKGROUND

Improvement is desired in the construction of component railing systems, particularly those made of composite materials, aluminum, and plastic materials, such as polyvinylchloride, that utilize generally upright hollow or at least hollow-ended balusters connected between opposed and generally lateral rails supported by posts.

The disclosure advantageously provides a railing system and a baluster plug system that facilitates installation of balusters at a plurality of angular orientations, such as installations for level railing and installations for non-level or angled railings such as for stairs, that enables components configured for level installations to be utilized for non-level or angled installations without modification.

SUMMARY

The disclosure relates to railing systems.

In one aspect, the railing system includes a lateral member having a planar lateral surface having a plurality of uniformly spaced apertures; a plurality of balusters having an end positioned adjacent to the lateral member, and a plurality of baluster plugs Each baluster plug is configured for fitting into an open end of one of the balusters and seating into one of the apertures of the lateral member. The baluster plug has a baluster engagement portion configured to be received by the open end of the baluster, a tab projecting from the baluster engagement portion, and a level mounting surface and an angled mounting surface defined on an opposite end of the baluster engagement portion for seating against the planar lateral surface of the lateral member when the baluster is installed. The railing system enables the balusters to be positioned at a plurality of angular orientations.

In another aspect, the railing system includes an upper lateral member having a planar lateral surface having a plurality of uniformly spaced apertures, and a lower lateral member spaced below and parallel to the upper lateral member and having a planar lateral surface having a plurality of uniformly spaced apertures. The system also includes a plurality of balusters positioned between the upper lateral member and the lower lateral member, and a plurality of baluster plugs.

Each baluster plug is configured for fitting into an open end of one of the balusters and seating into one of the apertures of the upper lateral member or the lower lateral member. The baluster plug has a baluster engagement portion configured to be received by the baluster, a tab projecting from the baluster engagement portion, and a level mounting surface and an angled mounting surface defined on an opposite end of the baluster engagement portion for seating against the planar lateral surface of the upper lateral member or the lower lateral member when the baluster is installed. The railing system enables the balusters to be positioned at a plurality of angular orientations.

In another aspect, the railing system includes an upper lateral member; a lower lateral member spaced below and parallel to the upper lateral member; a post; and a pair of mounts. One of the mounts is attachable to the post and the upper lateral member and one of the mounts is attachable to the post and the lower lateral member. The mounts enable the upper lateral member and the lower lateral member to be positioned at a plurality of angular orientations relative to the post.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to FIGS. 1-5, there is shown a railing system 10 including a baluster plug system 12 according to the disclosure. The railing system 10 incorporating the baluster plug system 12 is configured to be installed between a pair of posts, such as having a post P located at spaced apart locations with the railing system 10 there between. The post P may be of one piece construction or may be of component construction, and preferably includes a decorative base and cap as shown. The railing system 10 is also advantageously configured to include interior chases or passages such as for installation of wires, cables, and the like.

Figure 17:
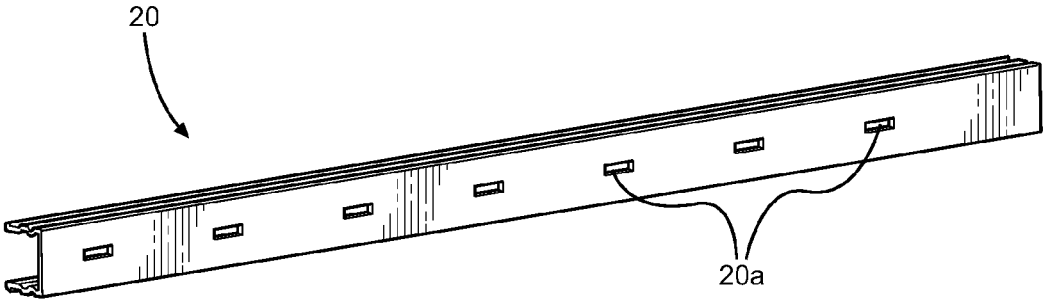
FIGS. 17-20 show a beam component of the railing system and baluster plug system of FIG. 1.
Figure 18:
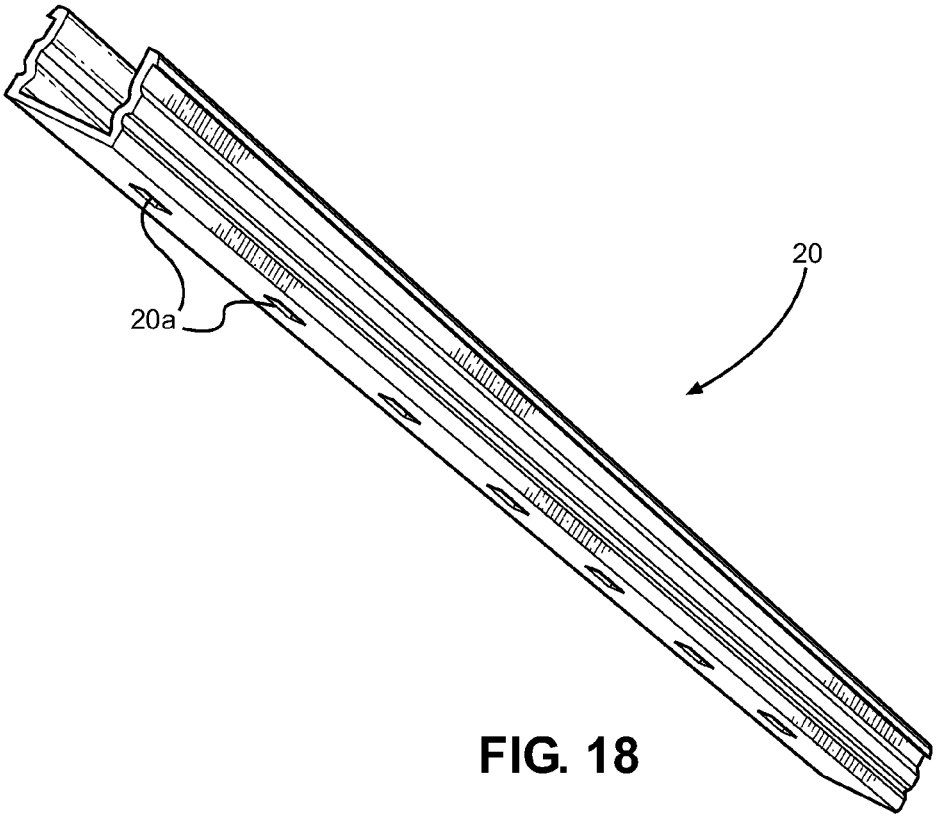
Figure 19:
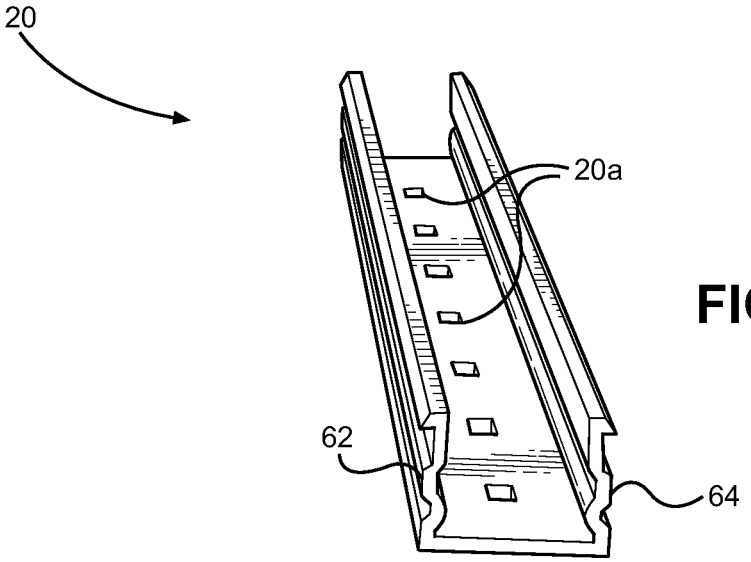
Figure 20:
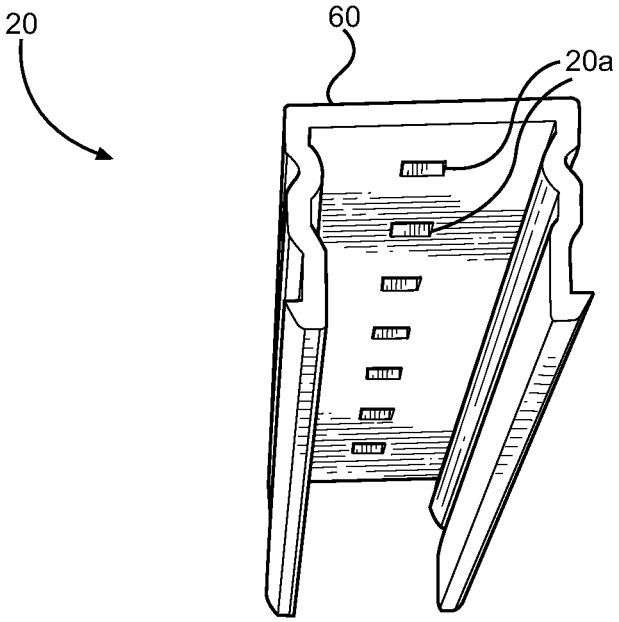
Figure 21:
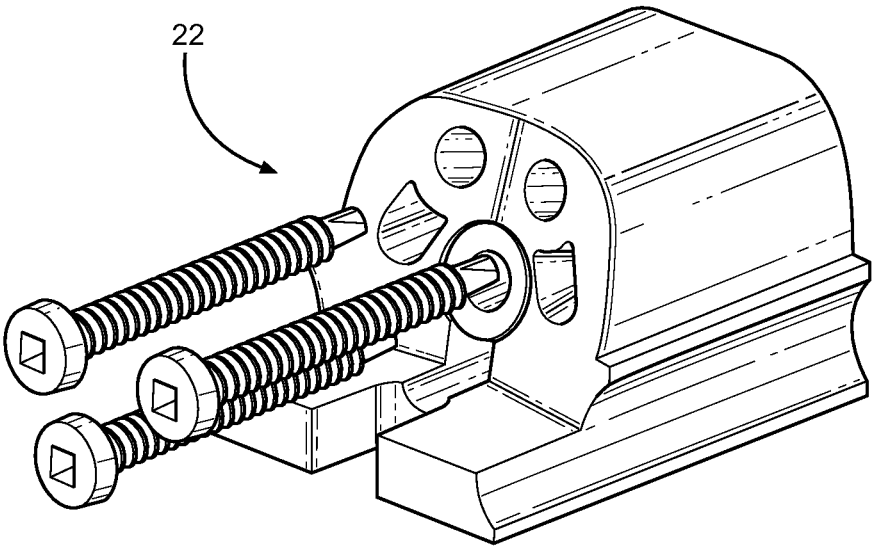
FIGS. 21-25 show a mount component of the railing system and baluster plug system of FIG. 1.
Figure 22:
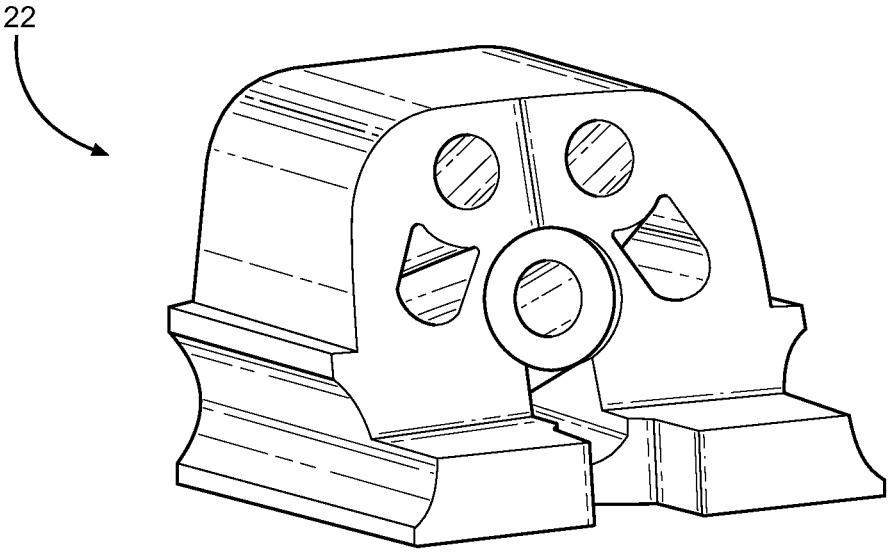
Figure 23:
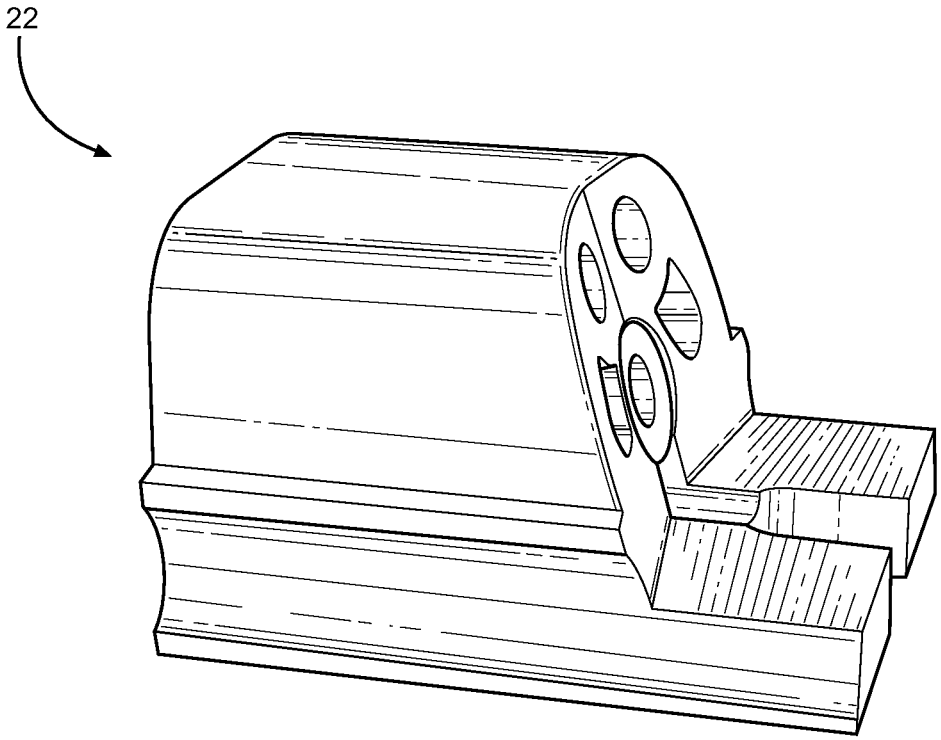
Figure 24:
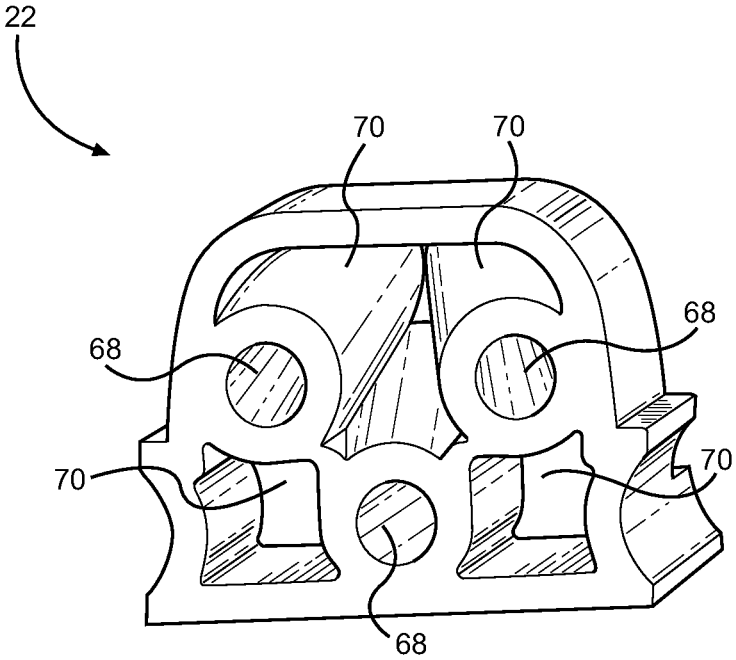
Figure 25:
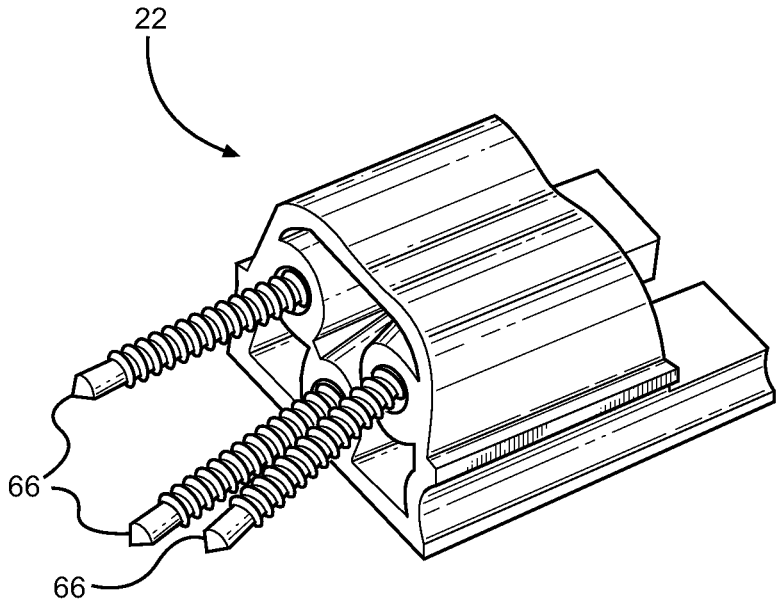

In a preferred embodiment, the railing system 10 includes beams 20 having slots 20*a* (FIG. 17), mounts 22, lower rail 24 having slots 24*a* (FIG. 5), and upper rail 26. The baluster plug system 12 includes a plurality of hollow or hollow-ended balusters 30 and baluster plugs 32.

The components of the systems may be made of various materials, such as composites, aluminum, and plastic. For the purpose of example, the beams 20, mounts 22, lower rail 24, upper rail 26, and the balusters 30 are made using extrusion techniques. The baluster plugs 32 are of plastic construction and made using injection molding techniques.

The railing system 10 and the baluster plug system 12 are configured so that the only fasteners utilized are those used to secure the mounts 22 to the posts P, with those fasteners being hidden from view. Thus, systems in accordance with the disclosure minimize the use of fasteners and avoid the use of exposed fasteners.

The railing system 10 and the baluster plug system 12 advantageously utilize components that facilitate installation at a plurality of angular orientations, such as installations for level railing and installations for non-level or angled railings such as for stairs. Thus, the systems according to the disclosure advantageously utilize components that can be used for both level installations and angled installations.

In this regard, a level installation will be understood to mean an installation wherein the angle of installation is about zero, and an angled installation has an angle of installation of greater than zero in the manner of a stair railing and the like that are inclined. In particular, the systems according to the disclosure enable railing and baluster installations having angles of installation of up to about 41 degrees.

For each installation, the slots 20*a* and the slots 24*a* are each the same, and the baluster plug 32 is advantageously configured to fills the slots 20*a* and 24*a* regardless of whether the installation is a level or an angled installation so that unsightly gaps and the like are avoided. The only modification required to permit an angled installation is to trim the ends of the balusters to the desired angle and the ends of the beams and rails to abut the posts.

Figure 1:
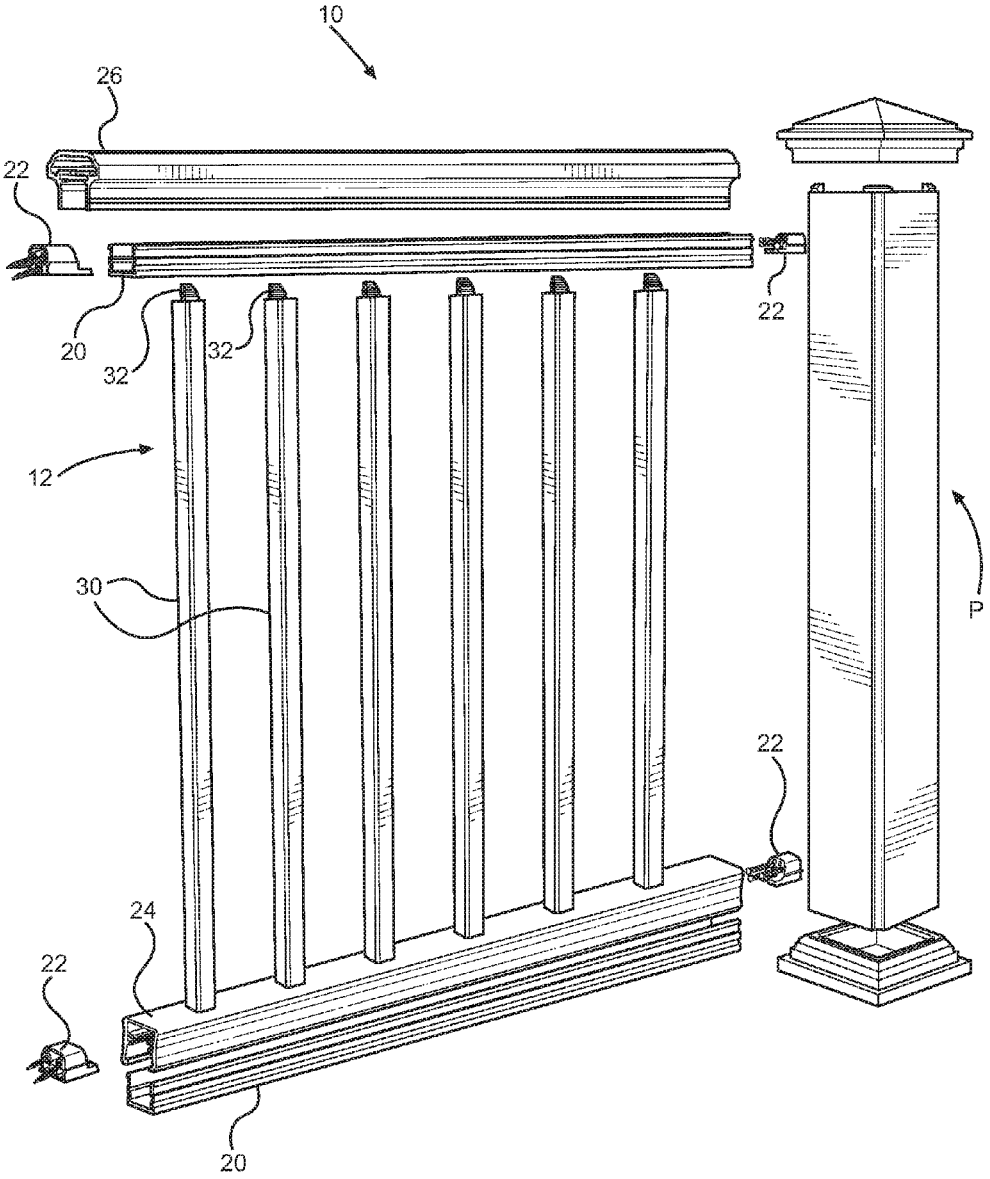
FIG. 1 is a partially exploded view of a railing system and baluster plug system according to the disclosure.
Figure 2:
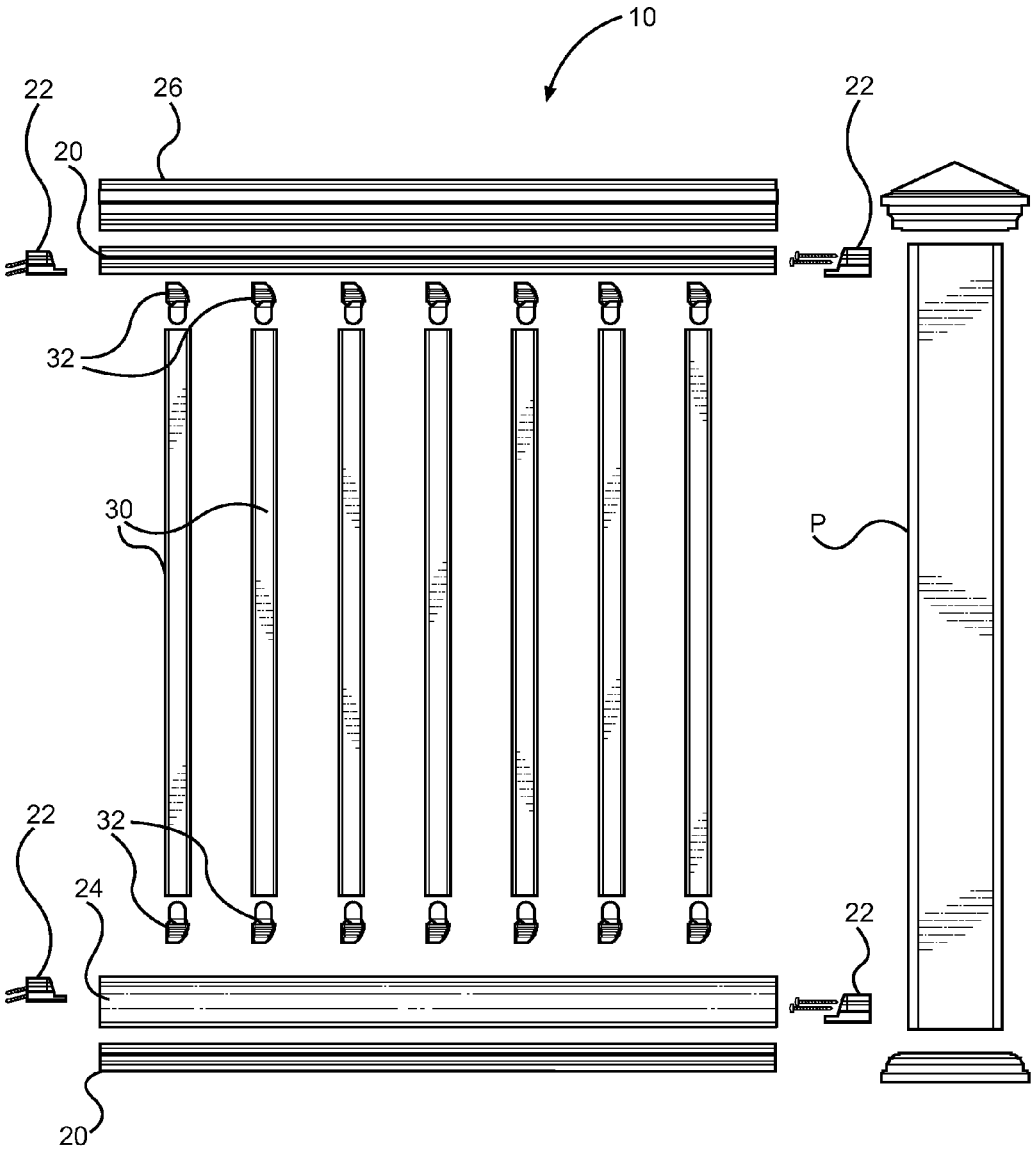
FIGS. 2-5 are further views of the railing system and baluster plug system of FIG. 1.
Figure 3:
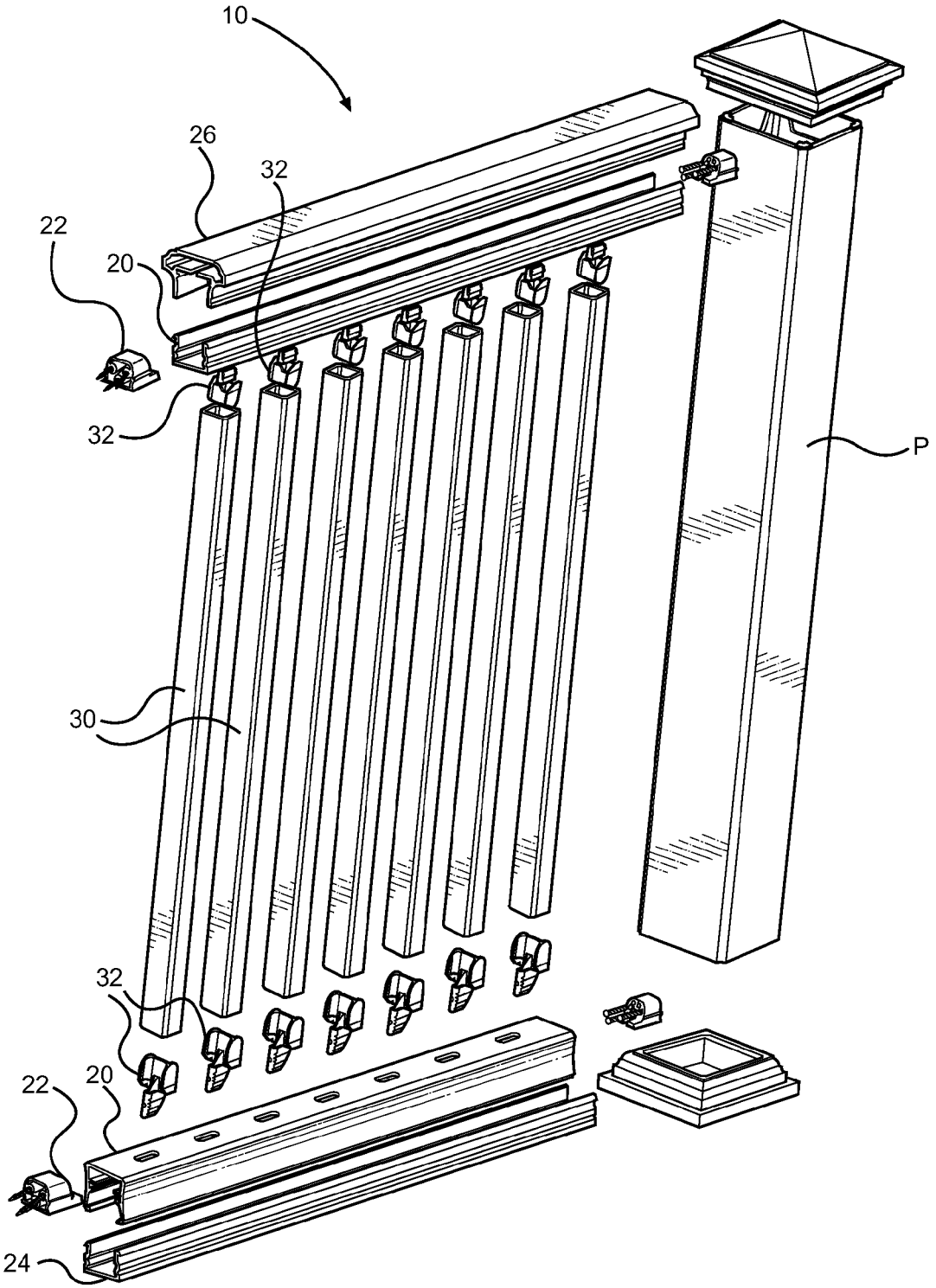
Figure 4:
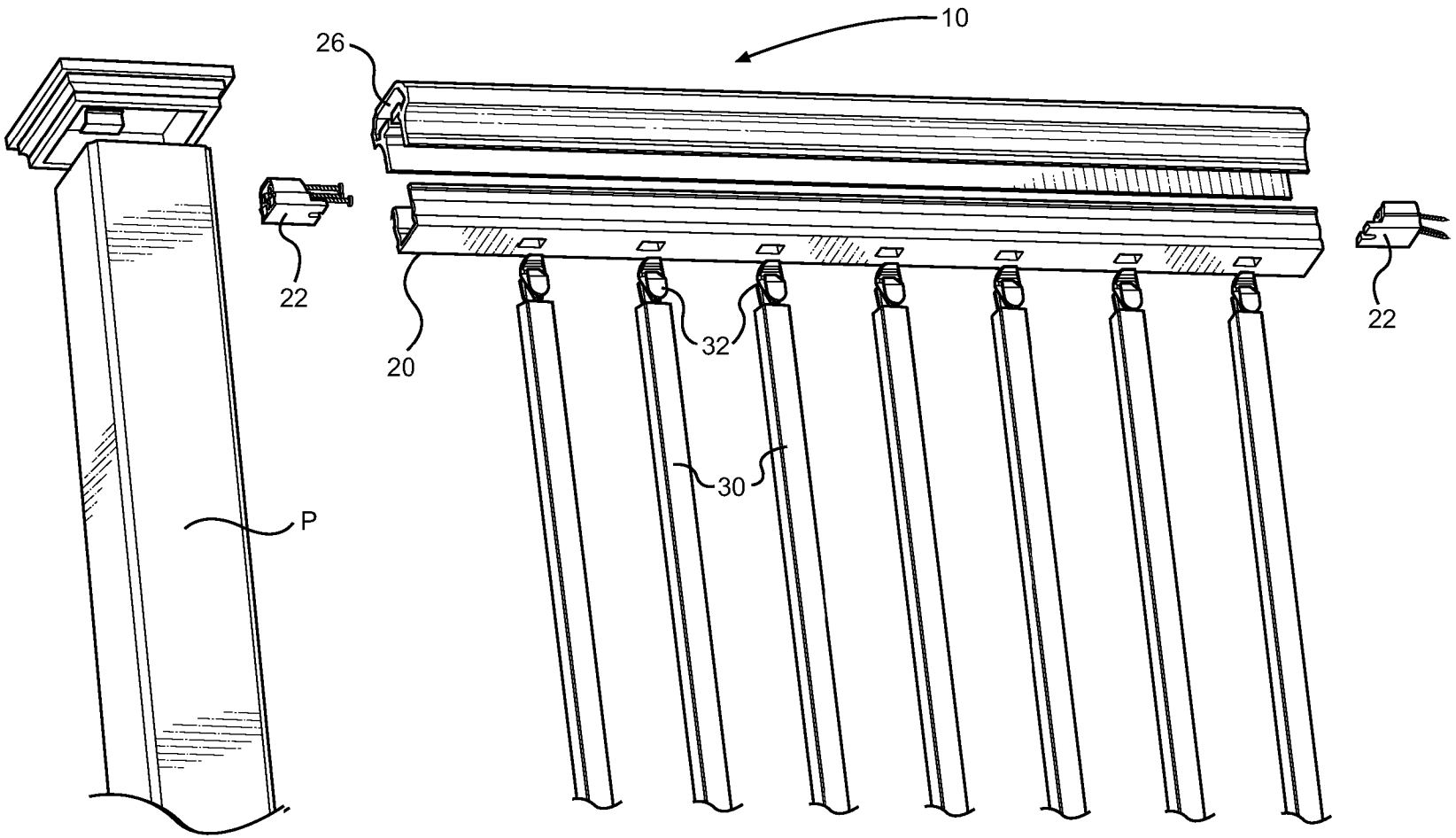
Figure 5:
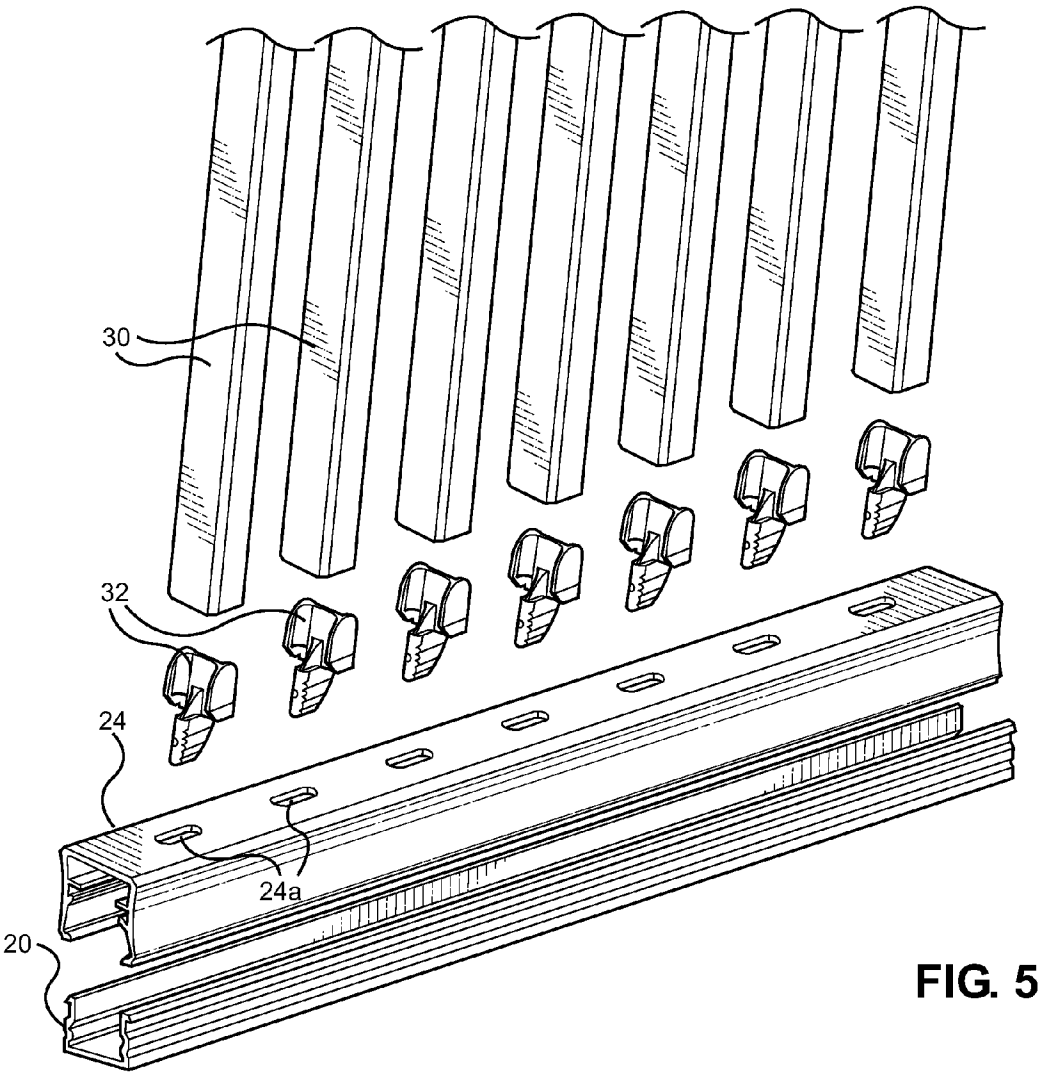
Figure 6:
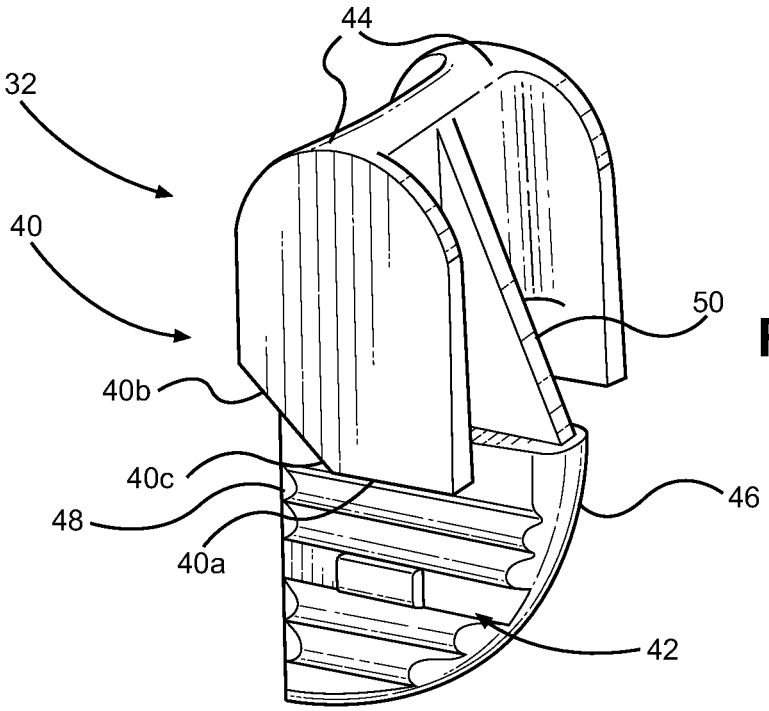
FIGS. 6-15 are various views of a baluster plug utilized in the railing system and baluster plug system of FIG. 1.
Figure 7:
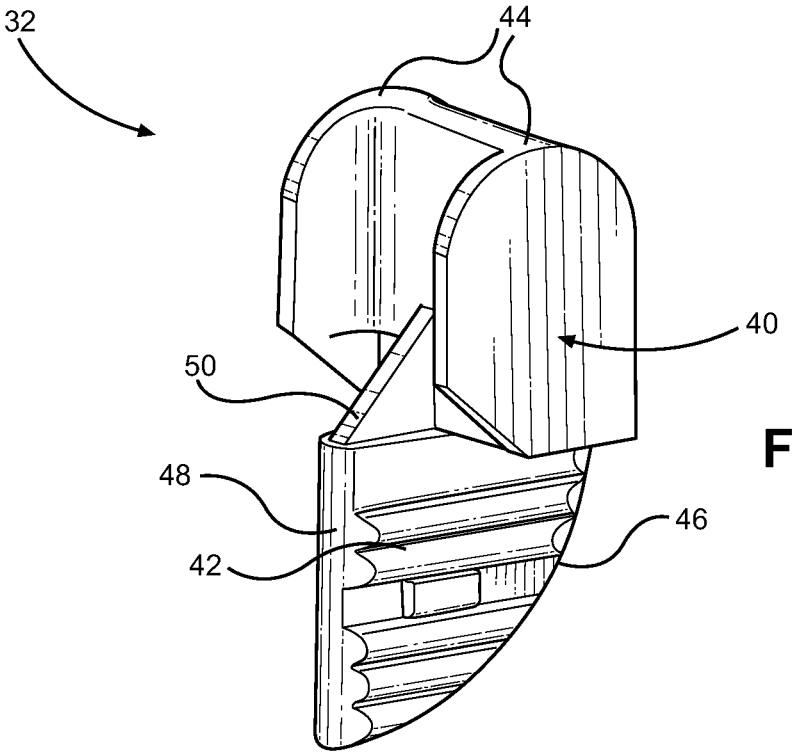
Figure 8:
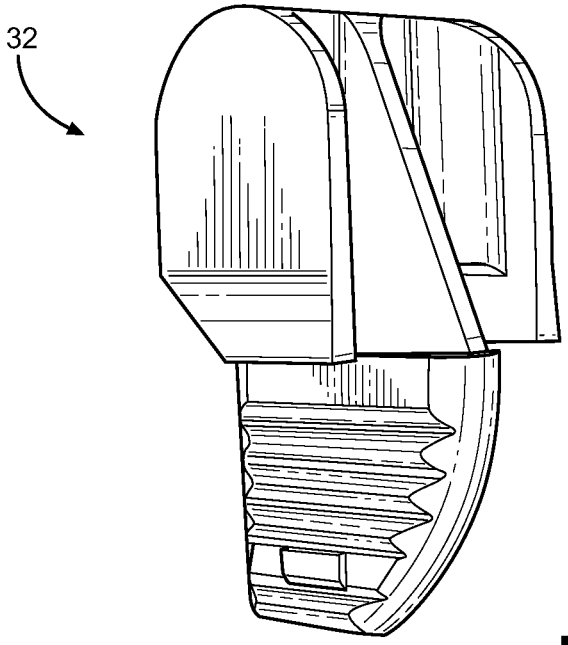
Figure 9:
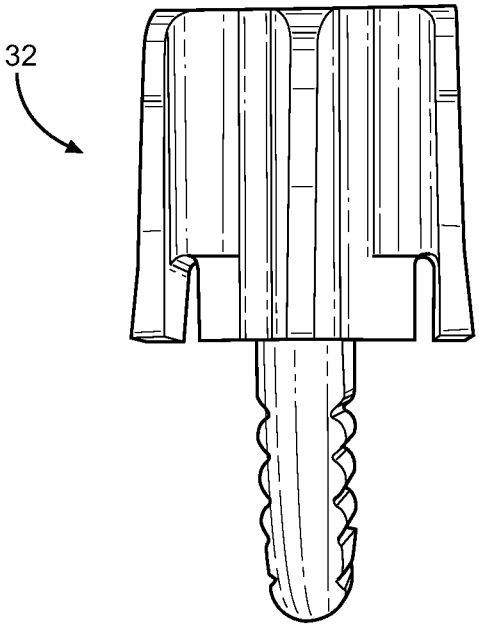
Figure 10:
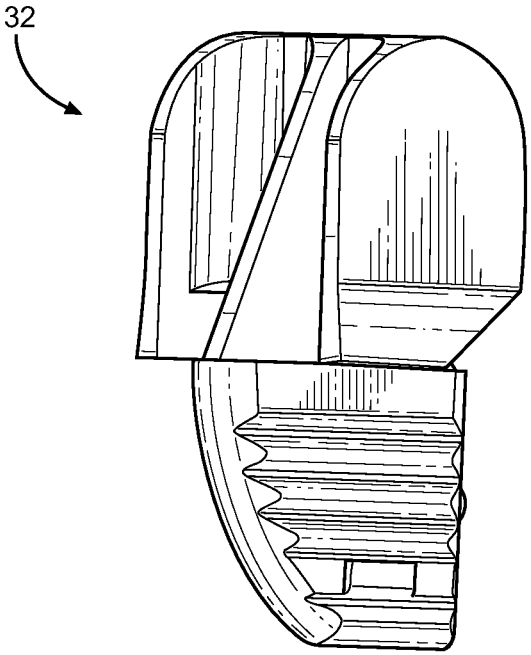
Figure 11:
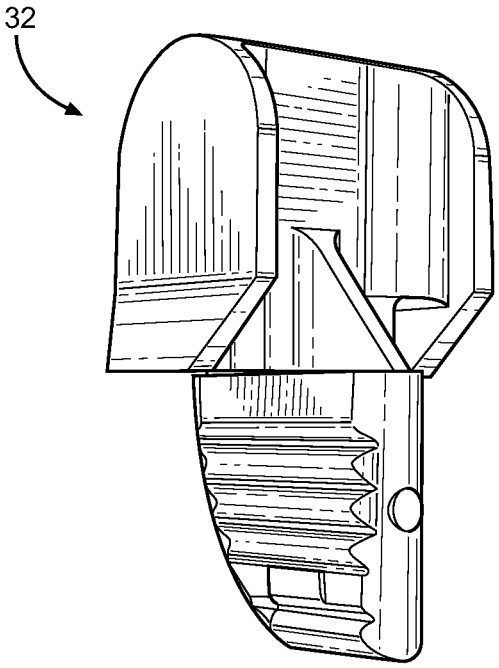
Figure 12:
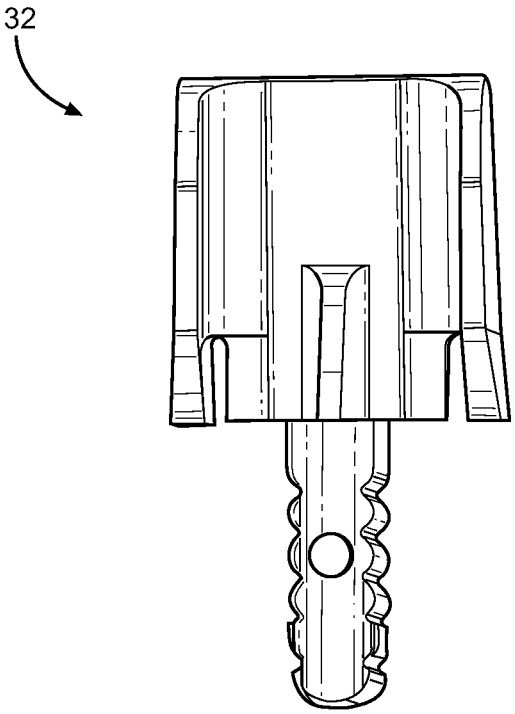
Figure 13:
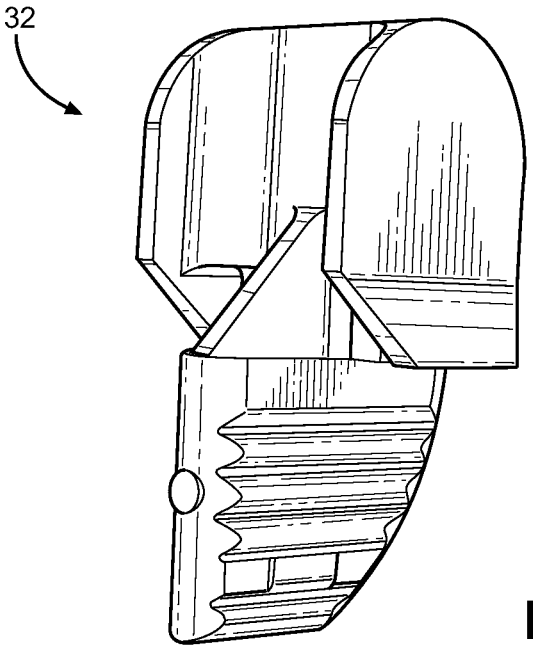
Figure 14:
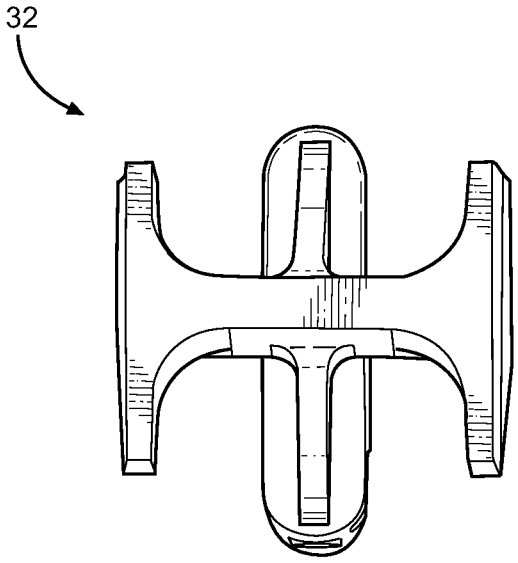
Figure 15:
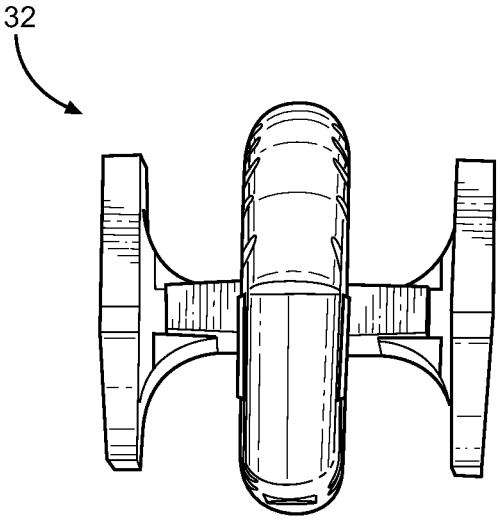
Figure 16:
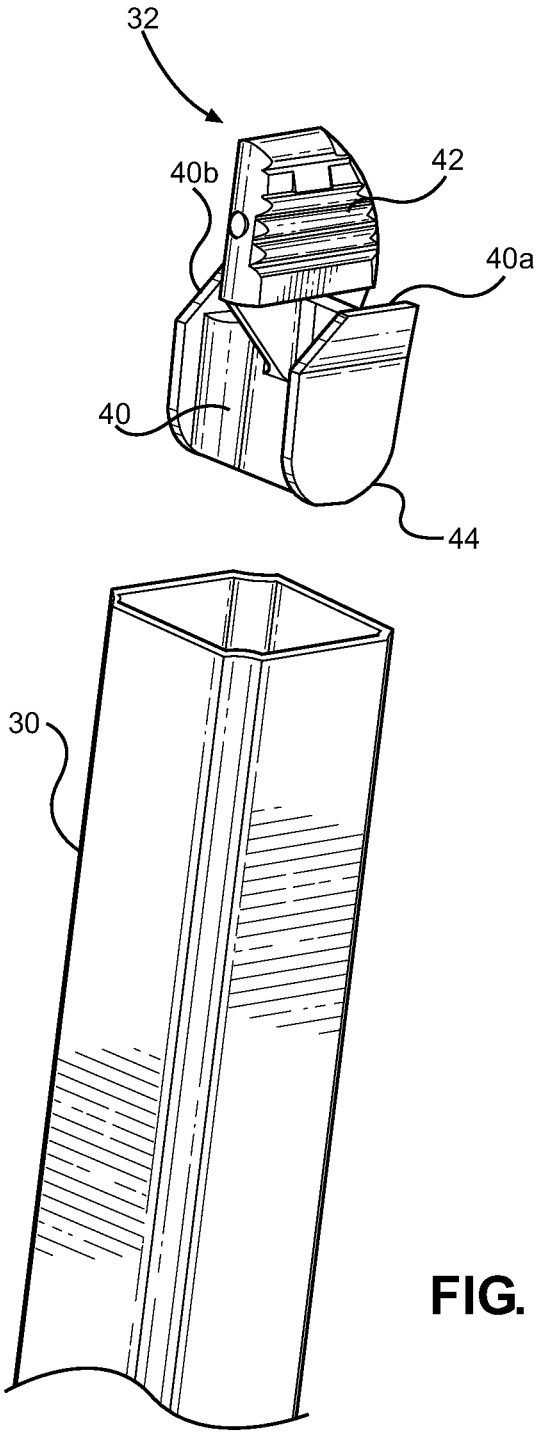
FIG. 16 shows the baluster plug of FIG. 6 relative to a baluster of the railing system and baluster plug system of FIG. 1.

The baluster plugs 32 are shown in FIGS. 6-15, and shown in relation to the baluster 30 in FIG. 16. The plugs 32 include a baluster engagement portion 40 configured to be received by the baluster 30 and a tab 42 projecting from the baluster engagement portion 40. An insertion end of the baluster engagement portion 40 includes rounded ends 44 to facilitate insertion of the baluster engagement portion 40 into the hollow end of the baluster 30. Level mounting surfaces 40*a* and angled mounting surfaces 40*b* are defined on the opposite end of the baluster engagement portion 40 for seating against either the beam 20 or the lower rail 24 when the baluster 30 is installed, as explained more fully below. A corner 40*c* transitions the level mounting surface 40*a* to the angled mounting surface 40*b*. The tab 42 is configured for extending into the slots 20*a* of the beam 20 and the slots 24*a* of the lower beam 24. The tab 42 includes a leading curved surface 46 and a trailing linear surface 48. The sides of the tab 42 are ribbed or otherwise configured with projections and the like for frictionally engaging the edges of the slots 20*a* and 24*a*. Reinforcements 50 extend between the baluster engagement portion 40 and the tab 42.

The beam 20 is shown in FIGS. 17-20, and is configured to provide a chase or open area for routing cables and the like. The beam 20 is used in connection with both the upper and lower portions of the railing system 10. In this regard, the beam 20 need not include the slots 20*a* when used in connection with the lower portion of the railing system. However, for standardization of manufacture, and to advantageously provide drainage structure, it is preferred to have the beam 20 include the slots 20*a* even when used with the lower railing portion. The beam 20 thus serves as a lateral member for mounting of the balusters 30 and includes a planar lateral surface 60 onto which the slots 20*a* are formed, as by routing. The lateral surface 60 is bounded by commonly depending legs 62 and 64 on opposite sides thereof. The legs 62 and 64 are profiled to cooperate with the lower rail 24 and the upper rail 26 so that the rails can be mounted thereon, as well as the mount 22 so that each end of the beam 20 may be engaged and supported by one of the mounts 22.

Figure 26:
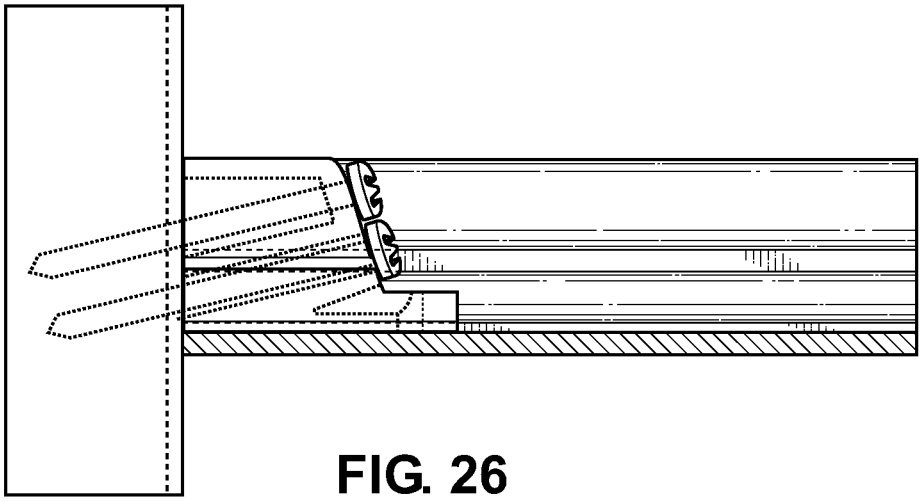
FIGS. 26-27 show the mount used for level and angled installations.
Figure 27:
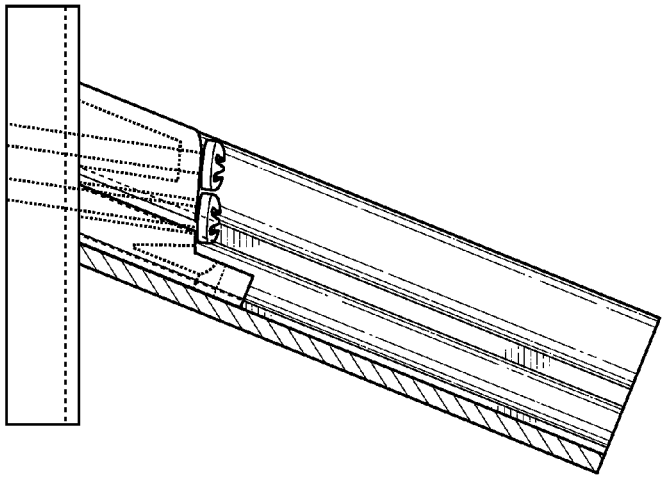

The mount 22 is shown in FIGS. 21-26. The mount 22 is configured to receive the beam 20 by a sliding or snap-fit to maintain the beam 20 on the mount 22 for support of the railing system 10. The mount 22 is secured to the post P as by the use of screws 66 or other fasteners extending through apertures 68. The screws 66 are hidden from view in the assembled railing system 10. To facilitate installation of cables, wiring and the like on the railing system 10, the mount 22 includes channels 70 for passage of such cables, wires, and the like. Another advantage of the railing system 10 is that the mounts 22 can be utilized for both level and angled installations. Conventional railing systems utilize different mount configurations for each different angle of the railing. The system 10 avoids this and enables the mounts 22 to be utilized for all installations. FIGS. 26-27 show the mount 22 used for level and angled installations.

Figure 28:
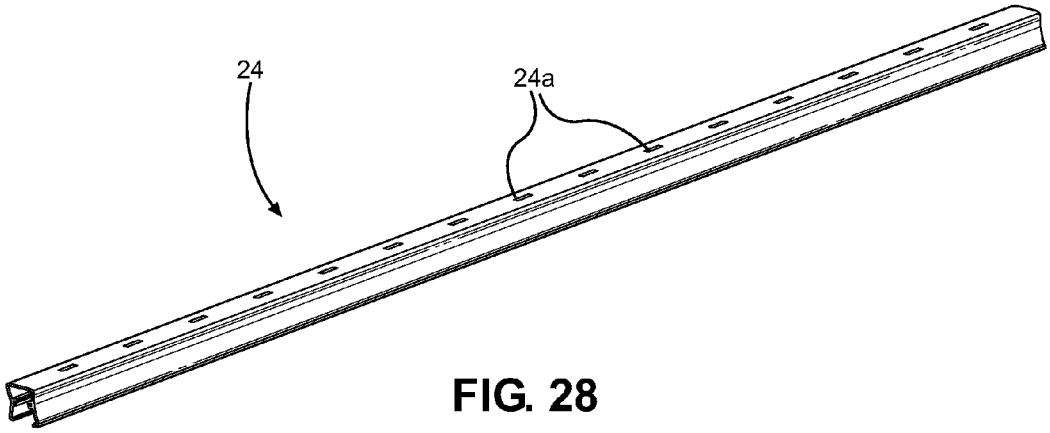
FIGS. 28-30 show a lower rail component of the railing system and baluster plug system of FIG. 1.
Figure 29:
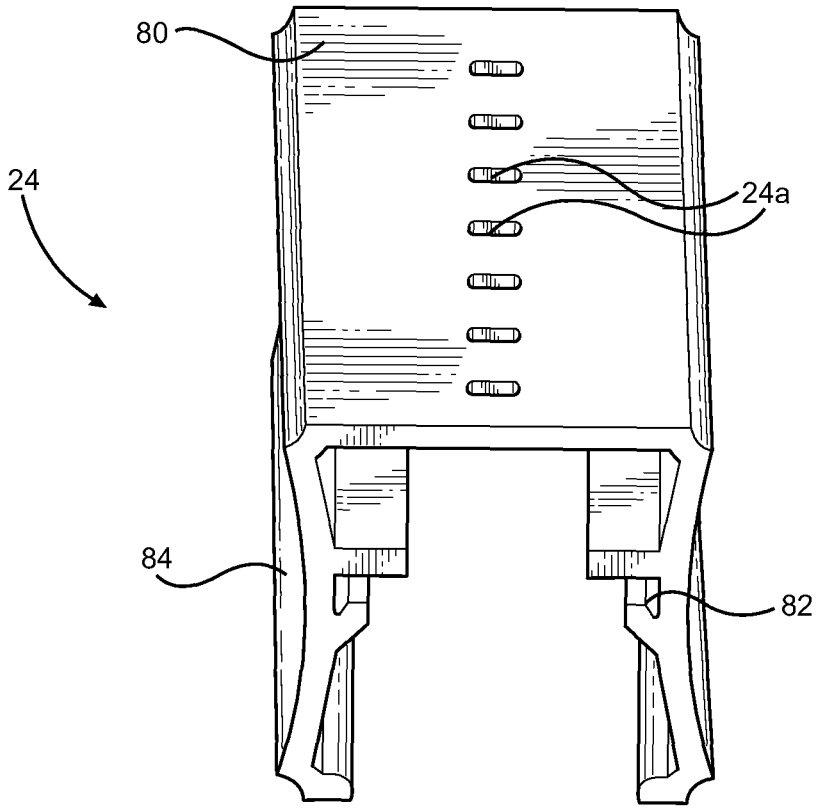
Figure 30:
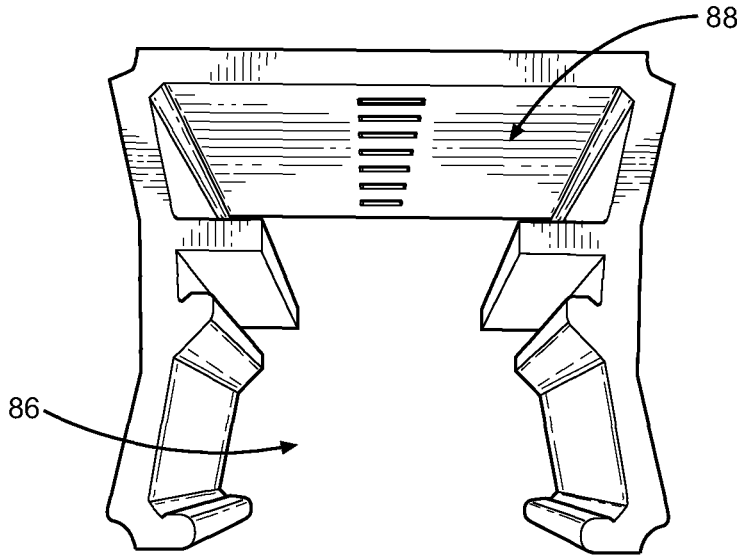

The lower rail 24 is shown in FIGS. 28-30. The lower rail 24 serves as a lateral member for mounting of the balusters 30 and includes a planar lateral surface 80 onto which the slots 24*a* are formed, as by routing. The lateral surface 80 is bounded by commonly depending legs 82 and 84 on opposite sides thereof. The legs 82 and 84 are profiled to cooperate with the beam 20 so that the lower rail 24 can be mounted thereon, and to also include an interior chase or channel for routing of wires, cables, and the like. The interior of the lower rail 24 includes a beam channel 86 for location of the beam 20 and an auxiliary channel 88 separate from the beam channel 86 for locating wires, conduits, cables, and the like.

Figure 31:
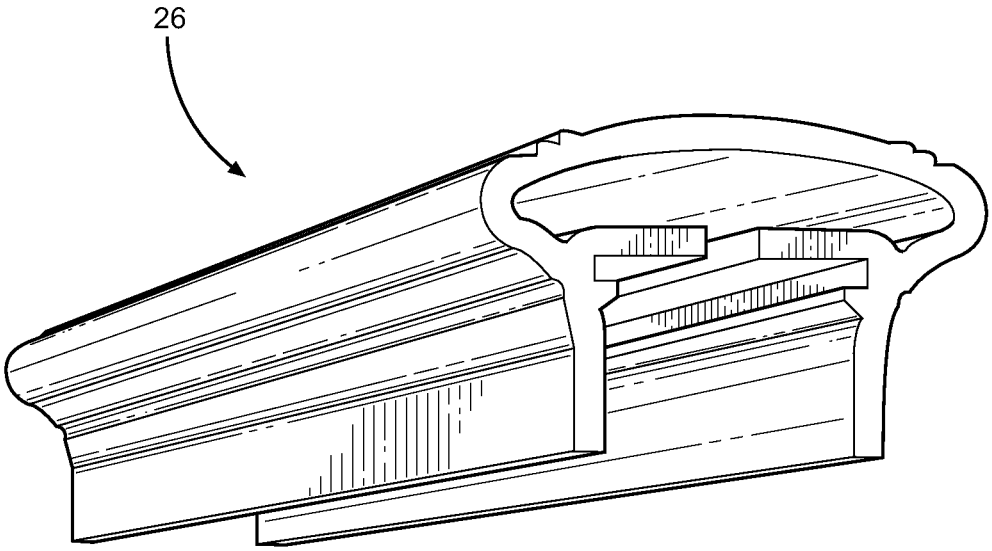
FIGS. 31-32 show an upper rail component of the railing system and baluster plug system of FIG. 1.
Figure 32:
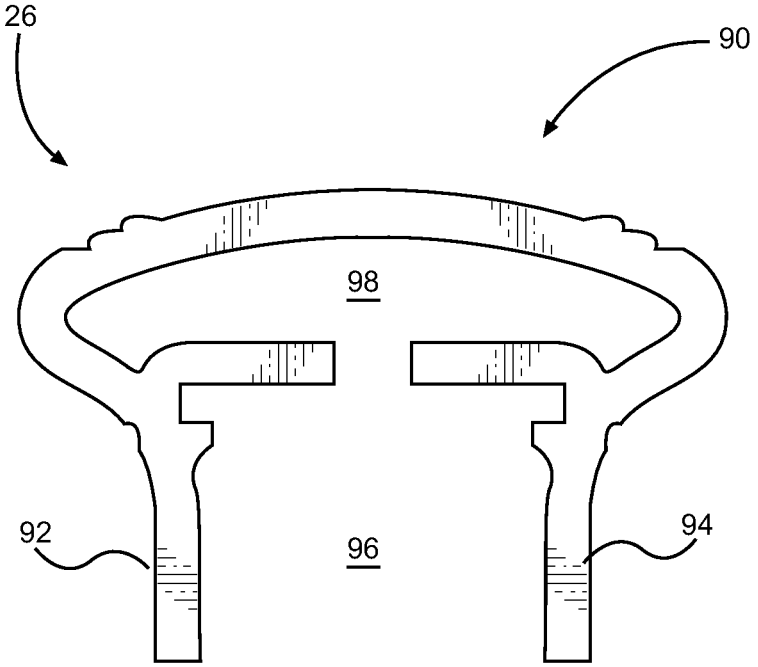

The upper rail 26 is shown in FIGS. 31-32. The upper rail 26 includes an upper decorative surface 90 bounded by commonly depending legs 92 and 94 on opposite sides thereof. The legs 92 and 94 are profiled to cooperate with the beam 20 so that the upper rail 26 can be mounted thereon, and to also include an interior chase or channel for routing of wires, cables, and the like. Accordingly, the interior of the upper rail 26 includes a beam channel 96 for location of the beam 20 and an auxiliary channel 98 separate from the beam channel 86 for locating wires, conduits, cables, and the like.

Figure 33:
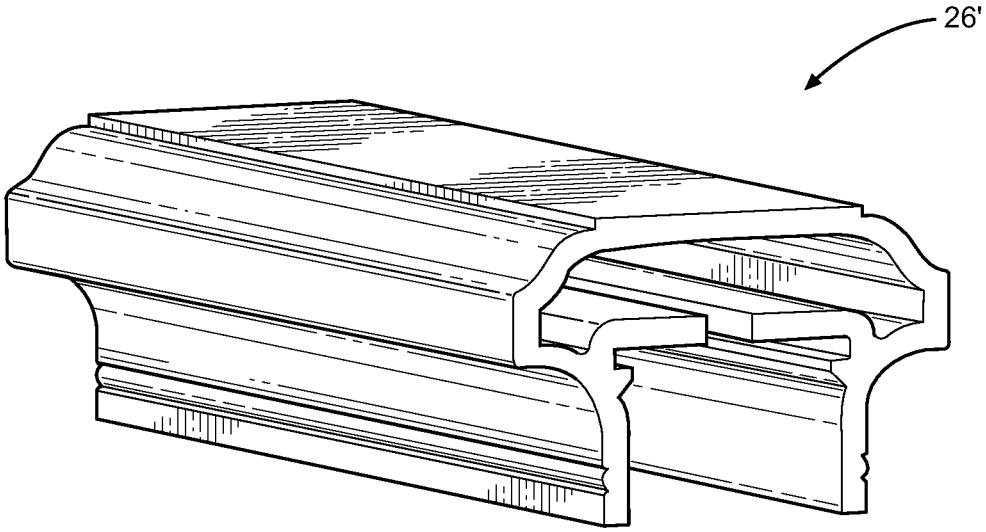
FIGS. 33-34 show an alternate embodiment of an upper rail component of the railing system and baluster plug system of FIG. 1.
Figure 34:
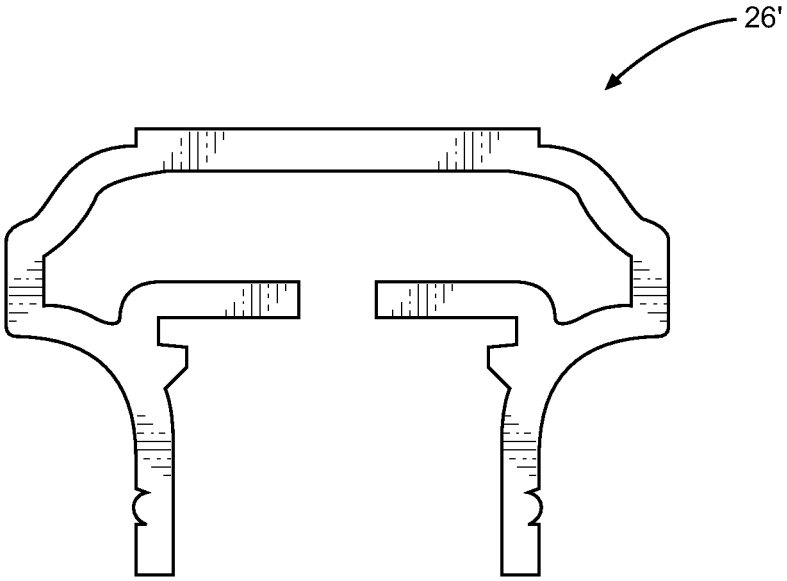

An alternate embodiment of an upper rail 26' is shown in FIGS. 33-34. The upper rail 26' is substantially the same as the upper rail 26, but differs in decorative appearance.

Figure 35:
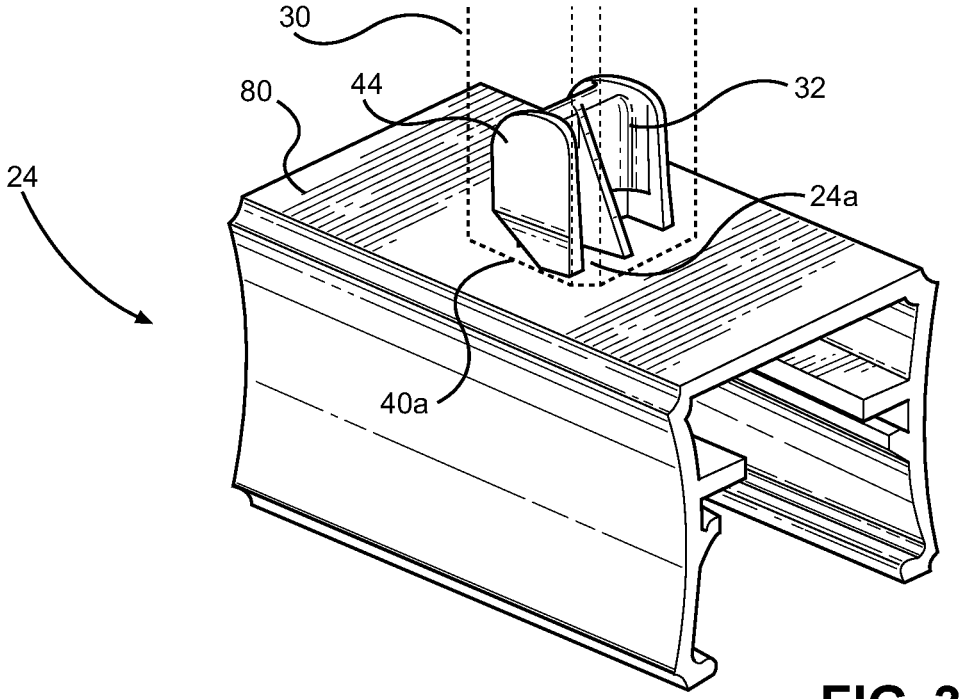
FIGS. 35-36 depict a level installation of the upper rail component of the railing system and baluster plug system of FIG. 1.
Figure 36:
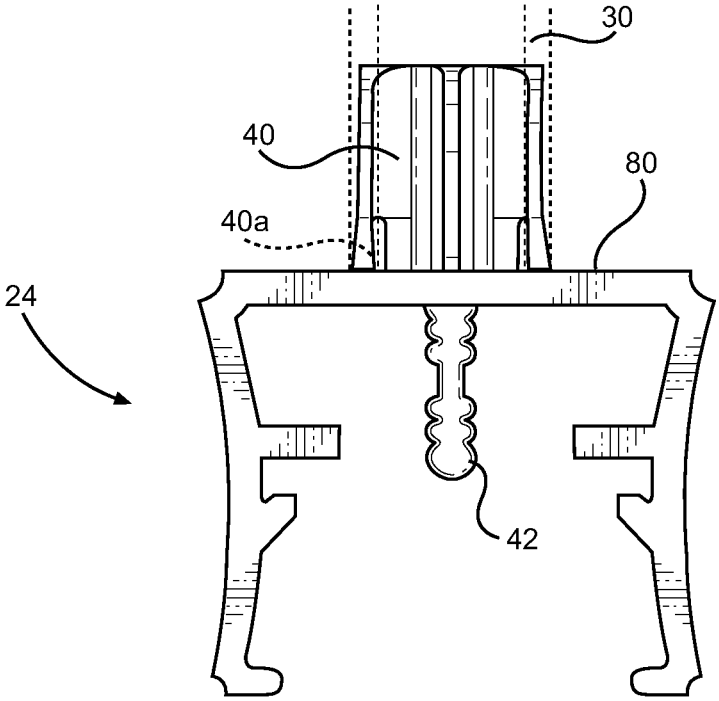

FIGS. 35-36 show cooperation of the baluster plug 32 with the baluster 30 and the lower rail 24 for a level installation. As will be observed, the baluster plug 32 cooperates with the slot 24*a* to enable the level mounting surfaces 40*a* of the plug 32 and the lower level surfaces of the baluster 30 to be flush with the surface 80 of the lower rail 24 with the tab 42 substantially filling the slot 24*a* so that unsightly gaps and the like are avoided.

Figure 37:
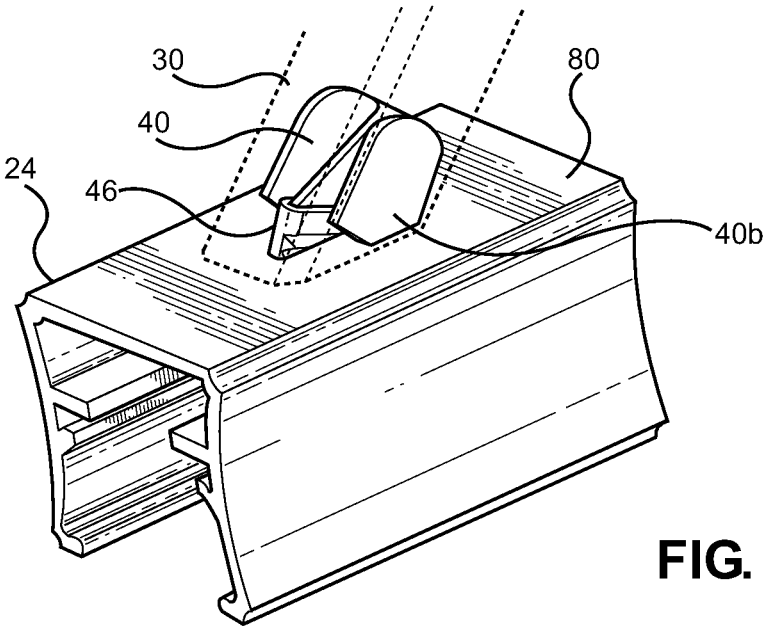
FIGS. 37-38 depict an angled installation of the upper rail component of the railing system and baluster plug system of FIG. 1.
Figure 38:
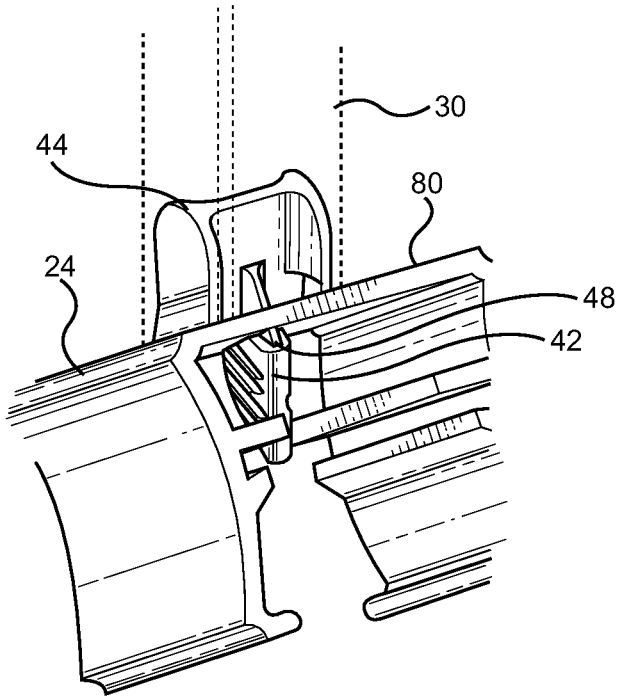

FIGS. 37-38 show cooperation of the baluster plug 32 with the baluster 30 and the lower rail 24 for an angled installation. For this installation, the ends of the baluster are cut to a desired angle of installation of up to about 41 degrees, and the beams and rails are cut so that the ends are angled to abut the posts.

As will be observed, the baluster plug 32 cooperates with the slot 24*a* to enable the angled mounting surfaces 40*a* of the plug 32 and the lower angled surface of the baluster 30 to be flush with the surface 80 of the lower rail 24 with the tab 42 substantially filling the slot 24*a* so that unsightly gaps and the like are avoided. The baluster plug 32 is thus advantageously configured to be suitable for both level and angled applications, such as stairs, which typically have an angled installation of from about 29 degrees to about 41 degrees.

It will be appreciated that the baluster plug 32 with the baluster 30 and the beam 20 cooperate in a similar manner for installation of the upper portion of the railing system.

Accordingly, the disclosure provides a railing system and a baluster plug system that facilitates installation of balusters at a plurality of angular orientations, such as installations for level railing and installations for non-level or angled railings such as for stairs, that enables components configured for level installations to be utilized for non-level or angled installations without modification.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed:

1. A railing system, comprising:

an upper lateral member having a planar lateral surface having a plurality of uniformly spaced apertures;

a lower lateral member spaced below and parallel to the upper lateral member and having a planar lateral surface having a plurality of uniformly spaced apertures;

a plurality of balusters having two open ends positioned between the upper lateral member and the lower lateral member; and a plurality of baluster plugs, each baluster plug fitted into an open end of one of the balusters and securing into one of the apertures of the upper lateral member or the lower lateral member, each baluster plug having a respective baluster engagement portion, the baluster engagement portion having a first side and a second side having an arched anterior baluster end and connected perpendicularly and at a medial point by a linear engagement piece to facilitate insertion of the baluster engagement portion into the open end of the baluster, the first side and second side being similar in length, wherein a posterior end of the first side and second side is divided into a level mounting surface and an angled mounting surface, a tab projecting from the baluster engagement portion, the tab having a plurality of ridges, wherein, in a first installed angular orientation, the level mounting surface of the baluster plug is flush with the planar lateral surface of one of the upper lateral member and the lower lateral member, and wherein, in a second installed angular orientation, the angled mounting surface of the baluster plug is flush with the planar lateral surface of said one of the upper lateral member and the lower lateral member.

2. The railing system of claim 1, wherein the balusters using the leveling mounting surface are positionable to be substantially vertical so as to extend substantially perpendicular to the upper and lower lateral members.

3. The railing system of claim 1, wherein the balusters using the angled mounting surface are positionable at an angle of from about 29 degrees to about 41 degrees relative to a perpendicular line normal to the planar lateral surfaces of the upper and lower lateral members.

4. The railing system of claim 1, further comprising a post and a pair of mounts, one of the mounts attachable to the post and the upper lateral member and one of the mounts attachable to the post and the lower lateral member, wherein the mounts enable the upper lateral member and the lower lateral member to be positioned at a plurality of angular orientations relative to the post, said mounts residing within the upper lateral member or the lower lateral member and comprising at least one aperture to receive at least one screw to be secured within the post.

5. The railing system of claim 1, wherein the tab of the baluster plug is a fin-shape, one side being straight and the other side being curved.

6. A railing system, comprising:

a lateral member having a planar lateral surface having a plurality of uniformly spaced apertures;

a plurality of balusters having an end positioned adjacent to the lateral member; and a plurality of baluster plugs, each baluster plug fitted into an open end of one of the balusters and seating into one of the apertures of the lateral member, each baluster plug having a respective baluster engagement portion, the baluster engagement portion having a first side and a second side having an arched anterior baluster end and connected perpendicularly and at a medial point by a linear engagement piece to facilitate insertion of the baluster engagement portion into the open end of the baluster, the first side and second side being similar in length, wherein a posterior end of the first side and second side is divided into a level mounting surface and an angled mounting surface, a tab projecting from the baluster engagement portion, the tab having a plurality of ridges, wherein, in a first installed angular orientation, the level mounting surface of the baluster plug is flush with the planar lateral surface, and wherein, in a second installed angular orientation, the angled mounting surface of the baluster plug is flush with the planar lateral surface.

7. The railing system of claim 6, wherein the balusters using the leveling mounting surface are positionable to be substantially vertical so as to extend substantially perpendicular to the lateral member.

8. The railing system of claim 6, wherein the balusters using the angled mounting surface are positionable at an angle of from about 29 degrees to about 41 degrees relative to a perpendicular line normal to the planar lateral surface of the lateral member.

9. The railing system of claim 6, wherein the tab of the baluster plug is a fin-shape, one side being straight and the other side being curved.

10. A railing system comprising:

an upper lateral member haying a planar lateral surface and having a plurality apertures;

a lower lateral member spaced below and parallel to the upper lateral member and having a planar lateral surface having a plurality of apertures;

a plurality of balusters having two open ends positioned between the upper lateral member and the lower lateral member; and a plurality of baluster plugs, each baluster plug having an anterior end to be fitted into an open end the baluster and a posterior end for securing the baluster plug into one of the apertures of the upper lateral member or the lower lateral member, each baluster plug having a baluster engagement portion at the anterior end, the baluster engagement portion having a first side and a second side that is arched at the anterior baluster end, the first side and second side connected by a linear engagement piece to facilitate insertion of the baluster engagement portion into the open end of the baluster, the first side and second side being similar in length and width, and wherein the first side and second side is divided into a level mounting surface and an angled mounting surface, the posterior end of the baluster plug haying a tab projecting from the baluster engagement portion, the tab having a plurality of ridges, wherein, in a first installed level orientation, the level mounting surface of the baluster plug is flush with the planar lateral surface of one of the upper lateral member and the lower lateral member and is not visible from the exterior, and wherein, in a second installed angular orientation, the angled mounting surface of the baluster plug is flush with the planar lateral surface of said one of the upper lateral member and the lower lateral member and is not visible from the exterior.

11. The railing system of claim 10, wherein the tab of the baluster plug is a fin-shape, one side being straight and the other side being curved.

12. The railing system of claim 10, wherein the tab is wider than either of the first side or the second side of the anterior end of the baluster plug.

13. The railing system of claim 10, wherein the engagement portion connects perpendicularly to a medial point of either the first side or the second side of the anterior end of the baluster plug.

14. The railing system of claim 10, wherein the balusters using the leveling mounting surface are positionable to be substantially vertical so as to extend substantially perpendicular to the lateral member.

15. The railing system of claim 10, wherein the angled mounting surface may be modified such that the balusters using the angled mounting surface are positionable at an angle of from about 29 degrees to about 41 degrees relative to a perpendicular line normal to the planar lateral surface of the lateral member.

16. The railing system of claim 10, wherein the plurality apertures are uniform in shape and spacing.

* * * * *